US007569526B2

(12) United States Patent
Costello et al.

(10) Patent No.: US 7,569,526 B2
(45) Date of Patent: Aug. 4, 2009

(54) ANTI-OXIDANTS IN SOLUBLE OIL BASE FOR METAL WORKING FLUIDS

(75) Inventors: Michael T. Costello, Southington, CT (US); Igor Riff, Waterbury, CT (US)

(73) Assignee: Crompton Corporation, Middlebury, CT (US)

( * ) Notice: Subject to any disclaimer, the term of this patent is extended or adjusted under 35 U.S.C. 154(b) by 469 days.

(21) Appl. No.: 10/800,288

(22) Filed: Mar. 12, 2004

(65) Prior Publication Data

US 2004/0204326 A1 Oct. 14, 2004

Related U.S. Application Data

(60) Provisional application No. 60/460,815, filed on Apr. 8, 2003.

(51) Int. Cl.

| | |
|---|---|
| ***C10M 133/12*** | (2006.01) |
| ***C10M 133/42*** | (2006.01) |
| ***C07C 211/55*** | (2006.01) |
| ***C07D 251/02*** | (2006.01) |

(52) U.S. Cl. ..... 508/563; 508/257; 564/433; 544/215

(58) Field of Classification Search ..... 508/545, 508/563, 257; 544/215; 564/433
See application file for complete search history.

(56) References Cited

U.S. PATENT DOCUMENTS

| | | | | |
|---|---|---|---|---|
| 2,711,374 A | | 6/1955 | Wasson | 106/14 |
| 2,976,244 A | | 3/1961 | Bennett | 252/51.5 |
| 3,240,701 A | | 3/1966 | Furia | 252/8.55 |
| 3,313,727 A | | 4/1967 | Peeler | 252/18 |
| 3,408,843 A | | 11/1968 | Treat | 72/42 |
| 3,515,671 A | | 6/1970 | Adams et al. | 252/54 |
| 3,591,679 A | | 7/1971 | Voss | 424/127 |
| 3,799,876 A | | 3/1974 | White et al. | 252/51.5 |
| 3,951,830 A | | 4/1976 | Karn | 252/42.7 |
| 4,163,729 A | | 8/1979 | Adams | 252/18 |
| 4,172,140 A | | 10/1979 | Shull et al. | 424/273 |
| 4,624,679 A | * | 11/1986 | McEntee | 8/650 |
| 4,846,986 A | | 7/1989 | Trivett | 252/49.5 |
| 4,925,582 A | * | 5/1990 | Bennett | 508/248 |
| 5,498,809 A | * | 3/1996 | Emert et al. | 585/13 |
| 5,981,632 A | * | 11/1999 | Fields | 524/60 |
| 6,075,065 A | * | 6/2000 | Yamazaki et al. | 522/64 |
| 6,172,122 B1 | | 1/2001 | Lawate et al. | 516/109 |
| 6,348,514 B1 | * | 2/2002 | Calabrese et al. | 521/130 |

FOREIGN PATENT DOCUMENTS

GB 2193972 A * 2/1988

OTHER PUBLICATIONS

Crompton Corporation Press Release, retrieved from the internet at <http://www.cromptoncorp.com/servlet/ContentServer?pagename=Crompton/ck_article/pressrelease&c=ck_article&cid=1042056763595&type=whatsnew>.*

Crompton Corporation Press Release, retrueved from the internet at <http://www.cromptoncorp.com/servlet/ContentServer?pagename=ck/pressrelease&c=ck_article&cid=1003866980424&p=984583117820&type=whatsnew>.*

Bennett E.O., Int. Biodetn. Bull. 9:95-100 (1973).

Gray and Wilkinson, J. Gen. Microbiol., 39:385-399 (1965).

J. App. Bact. 28:153-164 (1965).

Kane P. and Kray L., J. Soc. of Tribologists and Lubrication Engineers, 54(1):15-25 (1998).

* cited by examiner

*Primary Examiner*—Glenn Caldarola
*Assistant Examiner*—Jim Goloboy
(74) *Attorney, Agent, or Firm*—Jaimes Sher

(57) ABSTRACT

Disclosed herein is a method for reducing the oxidative and biological degradation of a metalworking fluid comprising adding thereto at least one antioxidant and at least one biocide.

2 Claims, No Drawings

ANTI-OXIDANTS IN SOLUBLE OIL BASE FOR METAL WORKING FLUIDS

We claim the benefit under Title 35, United States Code, § 119 of U.S. Provisional Application No. 60/460,815, filed Apr. 8, 2003, entitled ANTI-OXIDANTS IN SOLUBLE OIL BASE FOR METAL WORKING FLUIDS.

BACKGROUND OF THE INVENTION

1. Field of the Invention

The present invention is in the technical field of metalworking operations and lubricants used therein.

2. Description of Related Art

Lubricants are generally employed in metalworking operations. Such operations include rolling, forging, blanking, bending, stamping, drawing, cutting, punching, spinning, extruding, coining, hobbing, swaging, and the like. The present invention concerns improved lubricants for such metalworking operations, and in particular such operations as are employed in automotive and appliance applications. In the automotive and appliance fields, the term "stamping" is used as a broad term to cover all pressworking operations on sheet metal, which operations may be further categorized as cutting, drawing, or coining. Automotive and appliance stamped parts may be produced by one or a combination of these three fundamental operations.

Metalworking lubricants facilitate these operations generally by reducing friction between the metal being worked and the tooling employed for that process, and thus reducing the power required for a given operation, reducing the wear of the surfaces of the tooling that operate on the metals, and preventing sticking between the metal being worked and the tooling operating thereon or between metal pieces during storage, handling, or operations, and, in addition, often provide corrosion protection to the metal being processed. In automotive and appliance applications prevention of sticking between metal pieces and between such pieces and the work elements is of extreme importance.

In some metalworking processes, including automotive and appliance applications, coils or rolls of steel, in particular cold rolled or galvanized steel sheets, are cut into pieces, called blanks, that are stamped or drawn to produce the desired parts. Such automotive parts formed by stamping or drawing, as these terms are generally used, include fenders, hoods, deck lids, quarter panels, oil pans, fuel tanks, floor panels, inner and outer door panels, and the like. Appliance parts, formed by stamping and drawing, as these terms are generally used, include washer tops, dryer tops, washer fronts, dryer fronts, top and front lids and dryer tumblers, and the like. Prior to the use of lubricants known as prelubes, the normal procedure was to apply an oil at the steel mill to such coils or rolls as a rust preventative prior to shipping to the processing site, such as a stamping plant. Between the steps of cutting the sheets into blanks and stamping or drawing, such rust preventive oil would then be removed by cleaning and a drawing lubricant applied to the metal and at times the work element immediately before stamping or drawing. Such drawing lubricant is used to reduce friction and facilitate the metalworking operation.

In more recent times, the use of separate rust preventive oils and drawing lubricants has been in some instances replaced by the use of a single composition known as a prelube. Prelubes are generally applied at the steel mill during temper rolling or inspection, as was done with rust preventive oils, prior to shipping and are not intentionally removed from the metal until after the blanks are cut and the parts formed. Thus, the use of such prelubes eliminates the steps of removing the oil and applying a drawing lubricant before further working.

Prelubes thus must function as both a rust preventative and drawing lubricant. In many instances, and particularly for automotive and appliance applications, a prelube must be: (a) removable with alkaline cleaners, (b) non-staining to the metal, and (c) compatible with other chemicals utilized in producing the products in question.

As to metal staining, there are at times instances where steel coils are stored for long periods before use. Some substances may oxidize during storage and the oxidation product may adversely affect the metal, for example, by the oxidation of oils to fatty acids, which stain steel sheets, particularly mild steel sheets. Hence, industries in which storage periods are not uncommon require prelubes or other substances in contact with the metal during storage that are substantially non-staining. Additionally, with time these oils may be subject to attack by microorganisms yielding substances that may be detrimental to the desired properties of prelube.

Antimicrobial compositions are generally added to various kinds of industrial water based fluids to reduce or inhibit the growth of microorganisms. In particular, a wide variety of industrial water based fluids, such as metal-working fluids, latex paints, water based hydraulic fluids, require antimicrobial compositions to control the growth of microorganisms that eventually render the fluids rancid.

A number of suggestions have been made for inhibiting the growth of bacteria in aqueous fluids, such as those described in U.S. Pat. Nos. 4,172,140, 3,951,830, 3,799,876, 3,515,671, and 2,976,244. The use of various formaldehyde preservatives for metalworking fluids, including monomethylol dimethyl hydantoin and dimethylol dimethyl hydantoin, has also been proposed (see Bennett, E. O., *Int. Biodetn. Bull.* 9:95-100 (1973)).

Gray and Wilkinson in *J. Gen. Microbiol,* 39:385-399 (1965) and *J. App. Bact.,* 28:153-164 (1965) describe the action of the ethylenediaminetetraacetic acid (EDTA) on some bacteria. The effectiveness of such chelating agents as EDTA for bacterial control in aqueous systems is disputed as evidenced by U.S. Pat. Nos. 3,240,701; 3,408,843; and 3,591,679.

U.S. Pat. No. 2,711,374 discloses a corrosion inhibiting composition that comprises a synthetic aliphatic polybasic acid ester lubricating oil that contains small proportions of oil soluble petroleum sulfonate and similar proportions of natural animal fatty material and partial ester of polyhydric alcohol. To these are added lecithin in proportions of 0.01 to about 2% in combination with 0.1 to 1% of antioxidant, preferably of the alkylated phenol type.

U.S. Pat. No. 3,313,727 discloses an EP lubricant produced by the dispersion in a nonpolar lubricating oil of an inorganic hydrated sodium or potassium borate. To prepare the lubricant, the borate, water and an emulsifier were introduced into the nonpolar medium. The mixture was then agitated to produce a microemulsion of the aqueous borate solution in the oil and thereafter heated to remove the liquid water. It is also disclosed that conventional additives, such as rust inhibitors, foam inhibitors, etc., can be present in the finished lubricating composition containing the borate.

U.S. Pat. No. 4,163,729 discloses a synergistic extreme-pressure lubricating composition comprising an oil of lubricating viscosity having dispersed therein: (1) 0.1-60 weight percent of hydrated potassium borate microparticles having a boron to potassium ratio of about 2.5 to 4.5, (2) from 0.01 to 5.0 weight percent of an antiwear agent selected from (a) a zinc dihydrocarbyl dithiophosphate having from 4 to 20 carbons in each hydrocarbyl group; (b) a $C_1$-$C_{20}$ amine salt of a dihydrocarbyl dithiophosphoric acid having from 4 to 20 carbons in each hydrocarbyl group; (c) a zinc alkyl aryl sulfonate; or (d) mixtures thereof, and (3) from 0.1 to 5 weight percent of an oil-soluble antioxidant organic sulfur compound containing from 3 to 40 weight percent sulfur, which sulfur is present as organic sulfide or polysulfide or mixtures thereof.

U.S. Pat. No. 4,846,986 discloses an oil-in-water emulsion said to be useful as a metal working lubricant. The emulsion includes water, a oil-in-water emulsifier, a film plasticizer, and a boundry lubricant. A corrosion inhibitor may also be included.

U.S. Pat. No. 4,925,582 discloses that alkane alkanolamines of the formula $RNHR^1OH$ wherein R is hydrogen or normal $C_{1-6}$ alkyl; and $R^1$ is a normal or branched chain $C_{2-4}$ alkyl or hydroxymethyl $C_{2-4}$ alkyl are effective to potentiate the activity of and prolong the useful life of antimicrobial agents in controlling the growth of microorganisms in industrial water based fluids. A specific example of the alkanolamines employed is n-hexyl ethanolamine.

U.S. Pat. No. 6,172,122 discloses a stable emulsion composition that comprises: (A) a metal overbased gelled composition, prepared by forming a mixture of (i) a carbonated overbased material in an oleophilic medium, which material contains a metal salt of at least one organic acid material containing at least 8 carbon atoms, and (ii) an alcohol or an alcohol-water mixture; (B) a surfactant; and (C) an aqueous liquid. The stable emulsion composition may further comprise at least one of a solute, a suspended solid, or an oxidation inhibitor.

Japanese Patent Application No. 58-106540 discloses lubricating emulsions for metalworking that contain fats, mineral oils or fatty acid esters, and extreme pressure additive, and water soluble cationic or amphoteric polymer salt dispersions containing nitrogen. Thus, a lubricant was manufactured by mixing 95 wt % tallow, 2 wt % tallow fatty acid, 1 wt % poly(diethylaminomethyl methacrylate) phosphate, 1 wt % zinc phosphate, and 1 wt % 2,6-di-tert-butyl-p-cresol.

Kane, P. and Kray, L., *J. Soc. of Tribologists and Lubrication Engineers,* 54(1): 15-25 (1998) reported studies on coolant degradation and the development of a laboratory test method for predicting soluble oil emulsion oxidation stability.

The disclosures of the foregoing are incorporated herein by reference in their entirety.

SUMMARY OF THE INVENTION

The present invention is a result of a study wherein the effects of antioxidants in a controlled laboratory environment were measured. A series of metalworking emulsions were blended and were then oxidized with air sparging at ambient conditions for several weeks while the pH, emulsion stability, residue formation, and biological activity (bacterial and fungal growth) were monitored. Additionally, oxidation studies were conducted on metalworking emulsions using TOST (ASTM D943) and RBOT (ASTM D2272) to determine the relative effectiveness of several different types of antioxidants at temperatures above ambient. In particular, the effects of various aminic and phenolic antioxidants on metalworking fluids formulated with and without a biocide, especially triazine, were evaluated. A large positive synergy between the antioxidants and the biocide in both oxidative and biological stability testing was discovered.

More particularly, the present invention is directed to an improvement in a metalworking fluid, wherein the improvement comprises the addition thereto of at least one antioxidant and at least one biocide in amounts sufficient to reduce oxidative and biological degradation.

In another embodiment, the present invention is directed to a method for reducing the oxidative and biological degradation of a metalworking fluid comprising adding thereto at least one antioxidant and at least one biocide.

DESCRIPTION OF THE PREFERRED EMBODIMENTS

Examples of antioxidant additives that can be used in the practice of the present invention include alkylated diphenylamines and N-alkylated phenylenediamines. Secondary diarylamines are well known antioxidants and there is no particular restriction on the type of secondary diarylamine that can be used in the practice of the present invention. Preferably, the secondary diarylamine antioxidant is of the general formula $R_1$-—NH—$R_2$, where $R_1$ and $R_2$ each independently represent a substituted or unsubstituted aryl group having 6 to 46 carbon atoms. Illustrative of substituents for the aryl group are aliphatic hydrocarbon groups such as alkyl having 1 to 40 carbon atoms, hydroxyl, carboxyl, amino, N-alkylated amino, N',N-dialkylated amino, nitro, or cyano. The aryl is preferably substituted or unsubstituted phenyl or naphthyl, particularly where one or both of the aryl groups are substituted with alkyl such as one having 4 to 24 carbon atoms. Preferred alkylated diphenylamines that can be employed in the practice of the present invention include nonylated diphenylamine, octylated diphenylamine (e.g., di(octylphenyl) amine), styrenated diphenylamine, octylated styrenated diphenylamine, and butylated octylated diphenylamine.

The alkyl moiety of 1 to 40 carbon atoms can have either a straight or a branched chain, which can be either a fully saturated or a partially unsaturated hydrocarbon chain, e.g., methyl, ethyl, propyl, butyl, pentyl, hexyl, 2-ethyl hexyl, heptyl, octyl, nonyl, decyl, undecyl, dodecyl, tridecyl, tetradecyl, pentadecyl, hexadecyl, heptadecyl, octadecyl, oleyl, nonadecyl, eicosyl, heneicosyl, docosyl, tricosyl, tetracosyl, pentacosyl, tricontyl, pentatriacontyl, tetracontyl, and the like, and isomers and mixtures thereof.

Examples of some secondary diarylamines that can be employed in the practice of the present invention include: diphenylamine, dialkylated diphenylamine, trialkylated diphenylamine, or mixtures thereof, 3-hydroxydiphenylamine, 4-hydroxydiphenylamine, N-phenyl-1,2-phenylenediamine, N-phenyl-1,4-phenylenediamine, mono- and/or dibutyldiphenylamine, mono- and/or di-octyldiphenylamine, mono- and/or di-nonyldiphenylamine, phenyl-α-naphthylamine, phenyl-β-naphthylamine, di-heptyldiphenylamine, mono- and/or di-(α-methylstyryl)diphenylamine, mono- and/or di-styryldiphenylamine, N,N'-diisopropyl-p-phenylenediamine, N,N'-bis(1,4-dimethylpentyl)-p-phenylenediamine, N,N'-bis(1-ethyl-3-methylpentyl)-p-phenylenediamine, N,N'-bis(1-methylheptyl)-p-phenylenediamine, N,N'-diphenyl-p-phenylenediamine, N,N'-di-(naphthyl-2)-p-phenylenediamine, N-isopropyl-N'-phenyl-p-phenylenediamine, N-(1,3-dimethylbutyl)-N'-phenyl-p-phenylenediamine, N-(1-methylpentyl)-N'-phenyl-p-phenylenediamine, N-cyclohexyl-N'-phenyl-p-phenylenediamine, 4-(p-toluenesulfonamido)diphenylamine, 4-isopropoxydiphenylamine, tert-octylated N-phenyl-1-naphthylamino, and mixtures of mono- and dialkylated t-butyl-t-octyldiphenylamines.

Another example of the antioxidant types that can be used in the practice of the present invention is the hindered phenolic type. As illustrative of oil soluble phenolic compounds, may be listed alkylated monophenols, alkylated hydroquinones, hydroxylated thiodiphenyl ethers, alkylidenebis phenols, benzyl compounds, acylaminophenols, and esters and amides of hindered phenol-substituted alkanoic acids. In a preferred embodiment of the present invention, 3,5-di-t-butyl-4-hydroxy-hydrocinnamic acid, a $C_7$-$C_9$ branched alkylester of 2,6-di-t-butyl-p-cresol, and mixtures thereof are included in the lubricant compositions.

Another example of an antioxidant type that can be used in combination with the additives of the present invention are oil soluble copper compounds, and the like.

The following are exemplary of such additives and are commercially available from Crompton Corporation: Naugalube® 438, Naugalube 438L, Naugalube 640, Naugalube 635, Naugalube 680, Naugalube AMS, Naugalube APAN, Naugard® PANA, Naugalube TMQ, Naugalube 531, Naugalube 431, Naugard BHT, Naugalube 403, and Naugalube 420, among others.

In general, the antimicrobial agents that can be employed in the practice of the present invention include, but are not limited to, triazines, phenols, morpholines, "formaldehyde releasers" (i.e., compounds that will hydrolyze into formaldehyde and other non-persistent fragments in aqueous solution including, e.g., tris(hydroxymethyl)nitromethane, 1,3,5-tris(2-hydroxyethyl)-S-triazine, hexahydro-1,3,5-tris(2-hydroxyethyl)-S-triazine, hexahydro-1,3,5-triethyl-S-triazine, hexahydro-1,3,5-tris(2-hydroxyethyl)-S-triazine iodine complex, and 1-(3-chloroallyl)-3,5,7-triaza-1-azoniaadamantane chloride), azoniatricyclodecanes, omadines, oxazolidines, and the like. Examples of commercial products of such agents include, but are not limited to, those that are currently marketed under the trade designations: Triadine 3, Triadine 10, Grotan, Vancide TH, Dowicil, Dowicide A, Bioban P-1487, Tris Nitro, Busan 1024, Cosan 101, XBINX, Preventol CMK, and Nuosept 95. Grotan is 78.5% active solution of hexahydro-1,3,5-tris (2-hydroxyethyl)-S-triazine. Bioban P-1487 is a mixture of 70% 4-(2-nitrobutyl) morpholine and 20% 4,4-(2-ethyl-2-nitromethylene) dimorpholine. Triadine 10 is a mixture of sodium 2-pyridinethiol-1-oxide 6.4% and hexahydro-1,3,5-tris-(2-hydroxyethyl)-S-triazine 63.6%. Cosan 101 is 74.9% 4,4 dimethyloxazolidine and 2.8% 3,4,6 trimethyloxazolidine. Busan 1024 is a 40% aqueous solution of sodium salt of 1-carboxymethyl-3,5,7-triaza-1-azoniatricyclodecane chloride. Tris Nitro is a 50% active solution of tris(hydroxymethyl)-nitromethane. XBINX is 1,2 benzoisothiazolin-3-one. Preventol CMK is p-chloro-m-cresol. Nuosept 95 is a mixture of bicylicpolyoxymethylene oxazolidines.

Specific antioxidants used in the development of the present invention are listed below with a brief description of their chemistry.

Description of Antioxidants and Biocide

| Trade Designation | Description |
|---|---|
| AX 15 | Thiodiethylene-bis(3,5-di-t-butyl-4-hydroxyhydrocinnamate) |
| BHT | 2,6-di-t-butyl hydroxytoluene |
| Butylated DPA | butylated octylated diphenylamine |
| Naugalube APAN | octylated phenyl-α-naphthylamine |
| Naugalube 43 8L | mono-, di-, and tri-, nonylated diphenylamine |
| Naugalube 531 | 3,5-di-t-butyl-4-hydroxy-hydrocinnamic acid $C_7$-$C_9$ branched alkyl ester |
| Naugalube 640 | butylated octylated diphenylamine |
| Triadine 3 | 1,3,5-tris(hydroxyethyl)-s-triazine |

The emulsifier package used was the standard soluble oil base (a commercial soluble oil base of which Petromix HWN and Petromix HWP are examples) used for paraffinic oils diluted 10:1 in deionized water.

EXAMPLES

Examples 1-10

Modified ASTM D943

1. Fill the oxidation test tube with 300 ml of the emulsion sample provided.

2. When the first sample containing no antioxidant or biocide reaches a TAN (total acid number) of 2.0 mg/g KOH, stop all of the oxidations at that same time and measure the TAN. During the course of the testing it may be necessary to add a small amount of defoamer (1 drop of Foam Ban MS-575 from Ultra Additives) to prevent excessive foaming and loss of sample out of the top of the test apparatus.

3. Unless noted above the other test details are identical to ASTM D943

Modified ASTM D2272

1. Charge the vessel with 50 grams of the emulsion sample provided.

2. When the first sample containing no antioxidant or biocide shows a pressure drop of more than 175 psi, terminate all of the oxidations at that same time and record the pressure drops.

3. Unless noted above, the other test details are identical to ASTM D2272.

Modified ASTM D3946

1. Fill a 1-quart bottle with 800 mL of emulsion. (No steel chips were added.)

2. At ambient temperature, air was bubbled through the bottles using a disposable pipette at a flow rate of approximately 500 mL/min. (This may need to be adjusted depending on the air supply and the amount of foaming observed).

3. Measure the pH using standard pH paper or pH meter and bacteria/fungus count using SaniCheck BF culture plates (from Biosan Laboratories, Inc.) at one and two week intervals. The bacteria counts were measured by visual examination of the cell culture medium and compared to a standard reference after one and two day incubation periods. In many cases, it was difficult to evaluate the differences in bacteria count, so the bacterial evaluation was additionally determined by counting the weeks before the onset of any bacterial growth was observed on the cell culture.

4. Unless noted above the other test details are identical to ASTM D3946.

Modified ASTM D3946:

Emulsions of soluble oil base, biocide, and antioxidant were left in a room temperature hood and air was bubbled through for the test duration. During that period, the average room temperature fluctuated between 42 and 72° F. (about 6 to about 22° C.), and was thus more a simulation of field conditions than laboratory conditions. The pH was measured throughout the testing, but due to the low temperature of oxidation, the emulsions did not break due to degradation in the pH, which was a constant 8.5 to 9.0 throughout the testing (see Table 1).

The biological activity was evaluated using a Sanicheck BF Conversion Chart. It was found that after 24 hours the bacterial growth was quite sparse so an additional reading was taken at 48 hours and should be considered as relative comparisons and not an absolute bacterial count. Only bacteria were observed to grow in the samples, although occasionally asporadic growth of fungus would appear, which was not measured or found to be significant.

A comparison of the onset of bacterial growth after one day of incubation revealed that the addition of antioxidant in combination with biocide lowered the bacterial count below the level of the sample containing biocide alone, and that Naugalube 640 was the most effective antioxidant on this basis. Surprisingly, the antioxidant packages containing only Naugalube 640 or Naugalube 531 possessed onset times longer than packages containing biocide or biocide and antioxidant. The onset of bacterial growth after two days of incubation displayed the same reduction in a combination antioxidant/biocide package, but the results were no better than the baseline biocide package (see Table 1).

After 18 weeks of "aging" it was noted that a black precipitate was present in several of the samples. This precipitate was filtered and weighed and the results are included in Table 1. It was found that the presence of biocide produced the black precipitate, while the presence of antioxidant either had no effect or reduced the amount, as in the case of Naugalube 531. The black precipitate was analyzed by IR spectroscopy and prominent peaks were identified at 1746 $cm^{-1}$ from the carbonyl containing moieties, which probably arise from the oxidation of the metalworking fluid and at 1554 $cm^{-1}$ from the biocide (in this case, the N—H bond of the biocide). Additional O—H stretches were also prominent at 3400 $cm^{-1}$, which could either be attributed to the presence of water or the hydroxyl group on the biocide. Therefore, it is postulated that this black precipitate is the product of the basic aminic biocide and the oxidized metalworking fluid.

The steel chip corrosion test of the 10% emulsion aged oils revealed the samples containing Naugalube 640 and Naugalube 531 failed. At 4% emulsion only the antioxidant/biocide packages containing Naugalube 531 and Naugalube APAN possessed a passing result, while the antioxidant/biocide package containing Naugalube 438L narrowly failed (20 rusted chips, where passing is 10).

Modified ASTM D943:

Although the modified ASTM D3946 "Bottle" tests displayed differences in the bacteria and sediment formation, they did not successfully stress the system enough to produce emulsion breakdown. Accordingly, additional thermal stress was applied to accentuate differences in antioxidant performance. The test chosen to do this was a modified ASTM D943 run at 95° C., which it was expected would provide some oxidative breakdown of the metalworking fluid. The test was modified so that after the uninhibited sample had reached a TAN value of 2 mg KOH/g all of the oxidations were stopped so that the time of the oxidation would be a constant (typically the test is run to a constant TAN value and the time is allowed to vary).

It was found that the addition of both biocide and antioxidant (see Table 1) significantly reduced the TAN value. Additionally, the pH of all samples dropped from the initial 9.0 to 6.0, and a slight degradation in emulsion performance was observed for several of the blends. In particular, it was found that Naugalube 438L and Naugalube APAN performed well, with no significant cream, while the blank was a complete failure with 6.5% of heavy oil (see Table 1).

The steel chip corrosion test of the 5% emulsion aged oils revealed the sample containing Naugalube 438 failed. At 4% emulsion the biocide and antioxidant/biocide packages containing Naugalube 531 and Naugalube APAN possessed a passing result, as well as, the antioxidant package containing Naugalube 531. Clearly, the combination of Naugalube 531 and biocide is beneficial in corrosion testing.

Modified ASTM D2272:

With the success of the 95° C. modified ASTM, thermal breakdown for the metalworking fluids at even higher temperature was tested. The test chosen was a modified ASTM D2272 (RBOT) which is run at 150° C. in a sealed bomb, which should provide sufficient stress to provide significant oxidative breakdown of the metalworking fluid. The test was modified so that after the inhibited sample had reduced pressure by 175 psi, all of the oxidations were stopped so that the time of the oxidation would be a constant (typically the test is run to a constant pressure drop value and the time is allowed to vary). It was found that the addition of both biocide and antioxidant (see Table 1) significantly reduced the pressure drop. Additionally, the pH of all samples dropped from the initial 9.0 to 3.0, with the exception of the sample of Naugalube 640, which dropped to 7.0. In particular, it was found that the emulsion performance of Naugalube 640 performed well with little evidence of cream seperation (<1.0%), while the blank and the remaining samples were complete failures and formed 4% oil layers with negative emulsions.

As a cross check, the same samples were run using the standard ASTM D2272 procedure and it was found that the sample containing Naugalube 640 again displayed superior performance compared to all other blends (see Table 1). In fact, the test was terminated before a break point was ever observed.

The separated oil layer from the negative emulsions was analyzed by IR spectroscopy and qualitatively the spectra of all the samples (except for one which did not separate and therefore was not measured) were indistinguishable. Prominent peaks were identified at 1710 $cm^{-1}$ from the carbonyl-containing moieties, which may arise from the oxidation of the metalworking fluid and at 1605 $cm^{-1}$ from the aromatic ring of the sulfonate in the metalworking fluid.

TABLE 1

Results of Oxidative and Biological Stability Testing

| Blends TR93-10- | 1 | 2 | 3 | 4 | 5 | 6 | 7 | 8 | 9 | 10 |
|---|---|---|---|---|---|---|---|---|---|---|
| Shell MVT 100 | 80 | 79.5 | 79.5 | 79.5 | 79.5 | 79.5 | 79.5 | 79.5 | 79.5 | 79.5 |
| SOB | 20 | 20 | 20 | 20 | 20 | 20 | 20 | 20 | 20 | 20 |
| Naugalube 640 | | | 0.5 | 0.25 | | | | | | |
| Naugalube 438L | | | | | 0.5 | 0.25 | | | | |
| Naugalube 531 | | | | | | | 0.5 | 0.25 | | |

TABLE 1-continued

| Results of Oxidative and Biological Stability Testing | | | | | | | | | | |
|---|---|---|---|---|---|---|---|---|---|---|
| Blends TR93-10- | 1 | 2 | 3 | 4 | 5 | 6 | 7 | 8 | 9 | 10 |
| Naugalube APAN | | | | | | | | | 0.5 | 0.25 |
| Biocide (Triadine 3) | | 0.5 | | 0.25 | | 0.25 | | 0.25 | | 0.25 |
| Total | 100 | 100 | 100 | 100 | 100 | 100 | 100 | 100 | 100 | 100 |
| Tests | | | | | | | | | | |
| Bottle Test (ASTM 3946) (25 C.) | | | | | | | | | | |
| Bacteria Onset, 1 day (Wks) | 12 | 14 | 18 | 18+ | 12 | 18 | 18 | 18 | 12 | 18 |
| Bacteria Onset, 2 day (Wks) | 4 | 10 | 4 | 8 | 4 | 9 | 4 | 7 | 4 | 10 |
| pH | 9.0 | 9.0 | 9.0 | 9.0 | 9.0 | 9.0 | 9.0 | 9.0 | 9.0 | 9.0 |
| Sediment (Wt, g) | 0.118 | 0.385 | 0.088 | 0.252 | 0.108 | 0.191 | 0.035 | 0.134 | 0.096 | 0.276 |
| Emulsion Stability (ml) | good | good | good | good | good | good | good | good | good | good |
| Oil (%) | 0.0 | 0.0 | 0.0 | 0.0 | 0.0 | 0.0 | 0.0 | 0.0 | 0.0 | 0.0 |
| Cream (%) | 2.0 | 1.1 | 1.5 | 1.5 | 1.0 | 2.0 | 2.0 | 2.0 | 2.0 | 1.1 |
| Modified ASTM D943 (95 C.) | | | | | | | | | | |
| Aging Time (hrs) | 312 | 312 | 312 | 312 | 312 | 312 | 312 | 312 | 312 | 312 |
| TAN | 1.54 | 0.82 | 0.59 | 0.61 | | 0.6 | 0.7 | 0.78 | 0.61 | 0.77 |
| Emulsion Stability | good | good | good | good | | good | good | good | good | good |
| Oil (%) | 6.5 | 0 | 0 | 0 | | 0 | 0 | 0 | 0 | 0 |
| Cream (%) | 0 | 0.5 | 1.0 | 1.0 | | 0-ring | 1 | 1 | 0-br.ring | 1 |
| pH | 6.0 | 6.0 | 6.0 | 6.0 | | 6.0 | 6.0 | 6.0 | 6.0 | 6.0 |
| ASTM D2272 (150 C.) | | | | | | | | | | |
| Bomb Life (min) | 35 | 34 | no break | 34 | 36 | 30 | 31 | 30 | 30 | 28 |
| Modified ASTM D2272 (150 C.) | | | | | | | | | | |
| Pressure Max (psi) | 180.0 | 178.6 | 191.3 | 188.8 | 188.0 | 190.6 | 185.0 | 184.9 | 185.2 | 185.3 |
| Time to Max Pressure (min) | 11 | 11 | 20 | 18 | 19 | 15 | 13 | 12 | 12 | 11 |
| Pressure at 36 min. (psi) | 25.4 | 151.9 | 190.4 | 162.0 | 161.8 | 159.0 | 155.4 | 155.3 | 155.7 | 154.5 |
| Delta Pressure | 154.6 | 26.7 | 0.9 | 26.8 | 26.2 | 31.6 | 29.6 | 29.6 | 29.5 | 30.8 |
| Emulsion Stability | neg. | poor | good | good | good | poor | poor | poor-neg. | poor-neg. | poor-neg. |
| Oil (%) | 4.0 | 4.0 | 0-ring | 4.0 | 4.0 | 4.0 | 6.0 | 4.0 | 4.0 | 4.0 |
| Cream (%) | 0 | 0 | 0 | 0 | 0 | 0 | 0 | 0 | 0 | 0 |
| pH | 3.0 | 3.0 | 7.0 | 3.0 | 3.0 | 3.0 | 3.0 | 3.0 | 3.0 | 3.0 |

Examples 11-24

In Examples 1-10, a series of metalworking emulsions were blended and oxidized with air sparging at ambient conditions for several weeks while the pH, emulsion stability, residue formation, and biological activity (bacterial and fungal growth) were monitored. Additionally, oxidation studies were conducted on metalworking emulsions using TOST (ASTM D943) and RBOT (ASTM D2272) to determine the relative effectiveness of several different types of antioxidants at temperatures above ambient.

It was found that Naugalube 640 (butylated (30%) octylated (24%) diphenylamine) displayed surprisingly good performance in both the modified ASTM D3946 and modified ASTM D2272 tests. As a cross check of the procedure, the same samples were run using the standard ASTM D2272 procedure and it was found that the sample containing Naugalube 640 again displayed superior performance compared to all other blends. Additional phenolic based antioxidants were also investigated to determine if there were synergies with aminic based antioxidants.

The antioxidants used in this study were received from internal and external commercial sources without alteration. The sample of butylated DPA was from a preparation of Naugalube 640 in which the sample was enriched in butylated DPA. The methods ASTM D2272 and ASTM D943 were run according to the standard procedure and the results are listed in Table 2.

Combining the results of Examples 11-24 with those of Examples 1-10, the synergies involved in the oxidation testing used can be seen. In the ASTM D943 testing, the baseline used was the average Oxidation Lifetime (in hours) of the two separate runs of 0.5% Triadine-3 in Hyprene H100 (492 and 836 hr.). Hyprene H100 is a 100 SUS naphthenic oil. Although there is a large variation in the baseline, the general antioxidant chemistry trends (phenolic vs. aminic) were consistent. In the ASTM D2272 testing, the baseline used was the average Bomb Life (in minutes) of the two separate runs of 0.5% Triadine-3 in Hyprene H100, which were found to be quite consistent (35 and 37 minutes).

A large synergy was observed between Naugalube 640 and the biocide in ASTM D943 testing, while all other aminic and phenolic antioxidants possess an additive (linear) response. Surprisingly, there was no synergy observed with the butylated DPA sample, nor between the aminic Naugalube 438L and the phenolic antioxidants (BHT, Naugalube 531, AX 15) in ASTM D943 testing.

On the other hand, there was a large synergy between the butylated DPA and the biocide in ASTM D2272 testing, as well as a large improvement in performance for the aminic, Naugalube 640, and Naugalube 438L antioxidants. The phenolic (BHT, AX 15, and Naugalube 531) and naphthalene based (APAN) antioxidants were found to display no significant benefit over the baseline. Further, there was no synergy between the aminic Naugalube 438L and the phenolic antioxidants (BHT, Naugalube 531, AX 15) in ASTM D2272 testing.

TABLE 2

Results of ASTM D943 and ASTM D2272 Testing on Emulsions

| Additive | Example 11 | 12 | 13 | 14 | 15 | 16 | 17 |
|---|---|---|---|---|---|---|---|
| BHT | | | 0.5 | | | 0.25 | |
| Naugalube 531 | | | | | | | |
| AX 15 | | | | 0.5 | | | 0.25 |
| Butylated DPA | | | | | 0.5 | | |
| Naugalube 438L | | | | | | | |
| Triadine 3 | 0 | 0.5 | 0 | 0 | 0 | 0.25 | 0.25 |
| Oil (Shell MVI 100) | 80 | 79.5 | 79.5 | 79.5 | 79.5 | 79.5 | 79.5 |
| R-14D | 20 | 20 | 20 | 20 | 20 | 20 | 20 |
| RBOT (ASTM D2272) (150° C.) | | | | | | | |
| Bomb Life (minutes) | 35 | 33 | 33 | 32 | 72 | 27 | 29 |
| TOST (ASTM D943) (95° C.) | | | | | | | |
| Acid Number (0 hours) | 0.06 | 0.06 | 0.05 | 0.06 | 0.07 | 0.09 | 0.05 |
| Acid Number (500 hours) | 3.10 | 2.03 | 1.74 | 2.05 | 1.25 | 1.50 | 1.48 |
| Acid Number (668 hours) | | | 2.08 | | 1.59 | 1.9 | 1.85 |
| Acid Number (836 hours) | | | | | 2.01 | 2.53 | 2.26 |
| Acid Number (1104 hours) | | | | | | | |
| Acid Number (1172 hours) | | | | | | | |
| Acid Number (1340 hours) | | | | | | | |
| Calculated | 319 | 492 | 628 | 487 | 832 | 695 | 729 |

| Additive | Example 18 | 19 | 20 | 21 | 22 | 23 | 24 |
|---|---|---|---|---|---|---|---|
| BHT | | 0.125 | | | 0.225 | | |
| Naugalube 531 | | | 0.125 | | | 0.225 | |
| AX 15 | | | | 0.125 | | | 0.225 |
| Butylated DPA | 0.25 | | | | | | |
| Naugalube 438L | | 0.125 | 0.125 | 0.125 | 0.025 | 0.025 | 0.025 |
| Triadine 3 | 0.25 | 0.25 | 0.25 | 0.25 | 0.25 | 0.25 | 0.25 |
| Oil (Shell MVI 100) | 79.5 | 79.5 | 79.5 | 79.5 | 79.5 | 79.5 | 79.5 |
| R-14D | 20 | 20 | 20 | 20 | 20 | 20 | 20 |
| RBOT (ASTM D2272) (150° C.) | | | | | | | |
| Bomb Life (minutes) | 75 | 37 | 32 | 38 | 32 | 31 | 32 |
| TOST (ASTM D943) (95° C.) | | | | | | | |
| Acid Number (0 hours) | 0.07 | 0.12 | 0.10 | 0.10 | 0.10 | 0.05 | 0.07 |
| Acid Number (500 hours) | 1.24 | 1.45 | 1.44 | 1.62 | 1.42 | 1.35 | 1.44 |
| Acid Number (668 hours) | 1.57 | 1.66 | 1.79 | 1.88 | 1.83 | 1.58 | 1.62 |
| Acid Number (836 hours) | 2.01 | 1.81 | 1.79 | 2.05 | 2.04 | 1.82 | 1.8 |
| Acid Number (1104 hours) | | 2.01 | 2.02 | | | 1.71 | 2.01 |
| Acid Number (1172 hours) | | | | | | 1.66 | |
| Acid Number (1340 hours) | | | | | | | |
| Calculated | 832 | 1091 | 1081 | 787 | 804 | 1091 | 1091 |

Examples 25-51

In Examples 1-10, metalworking emulsions were blended and oxidized with air sparging at ambient conditions for several weeks in a modified ASTM D3946 procedure while the pH, emulsion stability, residue formation, and biological activity were monitored. The results demonstrated that the onset of bacterial growth is inhibited by the addition of antioxidant in combination with biocide and that Naugalube 640 was the most effective antioxidant by this criterion. Examples 25-34 describe bacterial growth inhibition of combinations of additional antioxidants and the biocide Triadine-3.

In Examples 11-24, oxidation studies were conducted on metalworking emulsions using TOST (ASTM D943) and RBOT (ASTM D2272) to determine the relative effectiveness of several different types of antioxidants at temperatures above ambient. As noted above, it was found that there was a large synergy between Naugalube 640 and the biocide in both ASTM D943 and ASTM D2272 testing, while all other aminic and phenolic antioxidants showed a linear response. It is known in the art that, in straight oil systems, synergy between the aminic and phenolic antioxidants is enhanced by the presence of a metal deactivator. Examples 35-41 describe the effects of adding a metal deactivator to the present systems.

The antioxidants used in this study were received from internal and external commercial sources without alteration. The sample of butylated DPA was from a preparation of Naugalube 640 in which the sample was enriched in butylated DPA.

The ASTM D2272 method was run according to the standard procedure using a 10/90 (oil/water) emulsion as a test sample.

A modified ASTM D3946 method was run according to the following procedure:

1. A 1-quart straight side jar was filled with 500 mL of emulsion. (Note: the straight sides of the jar allow culture plates to be immersed in the emulsion in situ. No steel chips were added.)

2. While immersed in a 25° C. water bath, the jars were sparged with air using a disposable pipette at a flow rate of approximately 500 mL/min. (Note: this may need to be adjusted depending on the air supply and the amount of foaming observed).

3. The pH was measured using standard pH paper or pH meter and bacteria/fungus counts were measured at one and two week intervals using culture plates (SaniCheck BF culture plates from Biosan Laboratories, Inc. were use in this study, but there are many suppliers available). Although the manufacturers protocol called for incubation between 24 and 36 hours, the bacteria counts were measured after 24, 30, and 48-hour incubations at 28° C. The bacterial onset was measured as the number of weeks necessary to observe at least a $10^3$ bacteria count/mL on the culture plate (threshold value of this type of plate). Optionally, the average bacterial count can be calculated over the length of the test period.

4. At the end of the test, the solutions were filtered through medium filter paper (Whatman #2) and the amount of sediment recovered was weighed.

5. Unless noted above, the other test details are identical to ASTM D3946.

The pH's of the test blends were measured during the course of study, but owing to the low temperature of oxidation, only the blank emulsion that did not contain antioxidant or biocide significantly degraded. In this case, after 22 weeks the pH broke and dropped from 9.0 to 7.0. In all other samples, the pH was measured between 8.5 and 9.0, without significant change over the test period.

The biological activity was evaluated using a Sanicheck BF Conversion Chart. The bacterial count was checked after 24, 30, and 48 hours of incubation. Owing to the variable nature of biological testing, it was decided that the first onset of bacterial growth would be used as a biological resistance measurement.

It was found that the results varied depending on the incubation period selected.

After 24 hours of incubation, the addition of antioxidant in a soluble oil significantly enhanced the biological resistance of the blends. It can be observed that the antioxidants BHT, AX 15, butylated DPA, and Naugalube 640 all possess longer onset times than the combinations with biocide or with biocide alone.

Conversely, after 30 hours of incubation, the combination of antioxidant and biocide in a soluble oil synergistically enhanced the biological resistance of the blends. It can be observed that combinations of biocide and the antioxidants BHT, AX 15, butylated DPA, and Naugalube 640 all possess longer onset times than either component individually. In fact, the synergy is strongest using Naugalube 640 and weakest (essentially a linear response) in the BHT blend.

Although the culture plates are only valid when read between 24 and 36 hours of incubation at 25-31° C., it was felt that an incubation of 48 hours would help determine differences in the testing when the bacterial growth was quite sparse. Interestingly, after 48 hours of incubation the addition of biocide (Triadine 3) in a soluble oil significantly enhances the biological resistance of the blends, while the presence of antioxidants had little or no effect. In fact, the best antioxidant performance observed was for the BHT, which is in contrast to the 24 and 30-hour incubation results.

There is a clear trend in the onset period and the incubation length for this testing. It appears that, as the incubation period is lengthened, the effect of biocide increases, while the effect of antioxidant decreases. This is exemplified by the fact that after 24 hours of incubation the antioxidant-containing blends possess the smallest bacterial growth, while after 48 hours the biocide-containing blends possess the smallest. As a consequence, the 36-hour incubation shows that a combination is the best.

The sediment was recovered form the modified ASTM D3946 test and it was found that the presence of biocide yielded the largest sediment, while the presence of the antioxidants AX 15, butylated DPA, and Naugalube 640 reduced the sediment. It was observed that the phenolic antioxidant, BHT, antagonistically increased the sediment in combination with biocide.

During the filtration of the samples containing no antioxidant it was noticed that the filtration was significantly slower than samples that contained antioxidant. It appeared that there was a slime layer formed in the antioxidant free samples, which clogged the filter and increased the filtration time.

As noted above, combinations of antioxidants had been run in the RBOT (ASTM D2272) test and no synergy had been found between Naugalube 438L and various phenolic antioxidants. Work by others has indicated that synergy is enhanced by the presence of metal deactivators, so the tests were repeated in the presence of Rheomet 39. The results of these tests (see Table 4) clearly demonstrate that even in the presence of a metal deactivator there is very little synergy between phenolic and aminic antioxidants in this metalworking emulsion system.

Additionally, a comparison of the RBOT results of fresh soluble oils and oils aged for 20 weeks in the modified ASTM D3946 testing was made. There was a strong correlation (r=0.83) between the two data sets, and the aged samples possess RBOT results having average times 15% lower than those of the fresh samples (see Table 5). Surprisingly, the t-test of these two data sets reveals that there is no statistically significant difference between these two results (95% confidence), which reinforces the observation that the oxidation of these samples is quite mild.

TABLE 3

Bacteria count Results of Modified ASTM D3946 Bottle Test

| Additive IR53-90- | 25 | 26 | 27 | 28 | 29 | 30 | 31 | 32 | 33 | 34 |
|---|---|---|---|---|---|---|---|---|---|---|
| BHT | | | 0.5 | | | | 0.25 | | | |
| AX 15 | | | | 0.5 | | | | 0.25 | | |
| butylated DPA | | | | | 0.5 | | | | 0.25 | |
| NL640 | | | | | | 0.5 | | | | 0.25 |
| Triadine 3 | 0 | 0.5 | 0 | 0 | 0 | 0 | 0.25 | 0.25 | 0.25 | 0.25 |
| Shell MVI 100 | 80 | 79.5 | 79.5 | 79.5 | 79.5 | 79.5 | 79.5 | 79.5 | 79.5 | 79.5 |

TABLE 3-continued

Bacteria count Results of Modified ASTM D3946 Bottle Test

| Additive IR53-90- | 25 | 26 | 27 | 28 | 29 | 30 | 31 | 32 | 33 | 34 |
|---|---|---|---|---|---|---|---|---|---|---|
| R-14D | 20 | 20 | 20 | 20 | 20 | 20 | 20 | 20 | 20 | 20 |
| Sediment | 0.102 | 0.136 | 0.074 | 0.080 | 0.079 | 0.079 | 0.239 | 0.111 | 0.098 | 0.135 |
| Biological Testing | | | | | | | | | | |
| Avg. - 24 hour incubation Bacteria Count 10* | 0.9 | 1.7 | 0.4 | 0.0 | 0.0 | 0.0 | 0.5 | 1.0 | 1.7 | 0.5 |
| Avg. - 30 hour incubation Bacteria Count 10* | 1.5 | 3.8 | 1.9 | 1.2 | 1.8 | 2.2 | 3.1 | 3.0 | 3.4 | 2.2 |
| Avg. - 48 hour incubation Bacteria Count 10* | 3.8 | 5.1 | 5.5 | 5.2 | 5.0 | 6.4 | 5.4 | 5.3 | 5.4 | 5.5 |
| Onset (24 hrs.) (wks.) | 22* | 16 | 29 | 29+ | 29+ | 29+ | 18 | 16 | 19 | 23 |
| Onset (30 hrs.) (wks.) | 2 | 12 | 2 | 2 | 4 | 2 | 8 | 16 | 16 | 23 |
| Onset (48 hrs.) (wks.) | 2 | 8 | 2 | 2 | 2 | 2 | 6 | 4 | 4 | 4 |

*pH broke

TABLE 4

RBOT Results of Biocide and Antioxidant in Soluble Oil R-14D

| | Example | | | | | | |
|---|---|---|---|---|---|---|---|
| Additive | 35 | 36 | 37 | 38 | 39 | 40 | 41 |
| BHT | 0.25 | | | | 0.125 | | |
| Naugalube 531 | | 0.25 | | | | 0.125 | |
| AX 15 | | | 0.25 | | | | 0.125 |
| Naugalube 438L | | | | 0.25 | 0.125 | 0.125 | 0.125 |
| Rheomet 39 | 0.05 | 0.05 | 0.05 | 0.05 | 0.05 | 0.05 | 0.05 |
| Triadine 3 | 0.25 | 0.25 | 0.25 | 0.25 | 0.25 | 0.25 | 0.25 |
| Oil (Shell MVI 100) | 79.45 | 79.45 | 79.45 | 79.45 | 79.45 | 79.45 | 79.45 |
| R-14D | 20 | 20 | 20 | 20 | 20 | 20 | 20 |
| RBOT (ASTM D2272) (150° C.) | | | | | | | |
| Bomb Life (minutes) | 32 | 30 | 29 | 59 | 45 | 34 | 47 |

In summary:

1. After 24 hours of incubation, the addition of antioxidant in a soluble oil significantly enhances the biological resistance in modified ASTM D3946 testing.

2. After 30 hours of incubation, the combination of antioxidant and the biocide Triadine 3 in a soluble oil significantly enhances the biological resistance in modified ASTM D3946 testing.

3. After 48 hours of incubation, the addition of the biocide Triadine 3 in a soluble oil significantly enhances the biological resistance in modified ASTM D3946 testing.

4. Regardless of whether a metal deactivator is present, the results of the RBOT testing demonstrate that there is no synergy between Naugalube 438L.

Examples 52-61

In Examples 1-10 and 25-51, it was shown that the onset of bacterial growth and the oxidative resistance of the metal-working fluid was improved in the presence of anti-oxidant after aging using the modified ASTM D3946 procedure. Although these studies demonstrated the effectiveness of the

TABLE 5

Comparison of RBOT Results of Fresh Soluble Oils and Aged for 20 Weeks under Modified ASTM D3946 Conditions

| | Example | | | | | | | | | |
|---|---|---|---|---|---|---|---|---|---|---|
| Additive | 42 | 43 | 44 | 45 | 46 | 47 | 48 | 49 | 50 | 51 |
| Oil (Shell MVI 100) | 80 | 79.5 | 79.5 | 79.5 | 79.5 | 79.5 | 79.5 | 79.5 | 79.5 | 79.5 |
| R-14D | 20 | 20 | 20 | 20 | 20 | 20 | 20 | 20 | 20 | 20 |
| Naugalube 640 | | | 0.5 | 0.25 | | | | | | |
| Naugalube 438L | | | | | 0.5 | 0.25 | | | | |
| Naugalube 531 | | | | | | | 0.5 | 0.25 | | |
| Naugalube APAN | | | | | | | | | 0.5 | 0.25 |
| Triadine 3 | | 0.5 | | 0.25 | | 0.25 | | 0.25 | | 0.25 |
| Total | 100 | 100 | 100 | 100 | 100 | 100 | 100 | 100 | 100 | 100 |
| RBOT (ASTM D2272) (150° C.) | | | | | | | | | | |
| Bomb Life - Fresh (minutes) | 36 | 37 | 74 | 48 | 53 | 52 | 32 | 31 | 30 | 30 |
| Bomb Life - Aged 20 weeks (minutes) | 35 | 40 | 56 | 38 | 36 | 32 | 29 | 32 | 30 | 31 |

use of antioxidant in metalworking fluid, the 20 to 30 week test length to differentiate formulations was undesirable. In this study, the test fluids were inoculated with bacteria before the aging was started (as described in ASTM D3946) in an attempt to increase the rate of degradation of the metalworking fluid and decrease the total test length. The results of these experiments are discussed below.

The antioxidants used in this study were received from internal and external commercial sources without alteration. The sample of butylated DPA was from a preparation of Naugalube 640 where the supernatant liquid was decanted and the solid residue was used as an enriched source of butylated DPA (for increased water solubility).

The modified ASTM D3946 method was run according to the procedure below:

1. Unless noted below the test details are identical to ASTM D3946.

2. The inoculum was prepared by first diluting a sample of used metalworking fluid 50/50 with tryptic soy broth (prepared as 30 grams per liter of water) and then aging the mixture with air sparging (500 mL/min) until the cell culture count was greater than $10^7$ bacteria/mL.

3. A 1-quart straight side jar was filled with 450 mL of emulsion and 50 mL of inoculum. (Note: the straight sides of the jar allow culture plates to be immersed in the emulsion in situ. No steel chips were added).

4. While immersed in a 25° C. water bath, the jars were sparged with air using a disposable pipette at a flow rate of approximately 500 mL/min. (Note: this may need to be adjusted depending on the air supply and the amount of foaming observed).

5. The pH was measured using pH paper or a standard meterand the bacteria/fungus count was measured as needed using culture plates (SaniCheck BF culture plates from Biosan Laboratories, Inc.). Although the manufacturer's protocol called for incubation between 24 and 36 hours, the bacteria counts were measured after 24, 30, and 48-hour incubations at 28° C. The bacterial onset was measured as the number of weeks necessary to observe at least a $10^3$ bacteria count/mL on the culture plate (threshold value of this type of plate). Optionally, the average bacterial count can be calculated over the length of the test period.

The bacterial count of all test fluids was measured at time zero after the inoculum was added. In all samples, regardless of formulation, the bacteria count was recorded as $>10^7$ bacteria/mL after the initial inoculation. After one day of aging, the bacterial counts of the samples containing biocide were reduced to zero, while blends containing only antioxidant were still above $10^7$ bacteria/mL. For the samples that displayed bacterial reduction, the onset of the "rebloom" of bacteria in the system was measured, as well as the onset of the pH drop.

The pH of the test blends during the course of the 7-week study was studied, and a distinct dip in the curve was observed as the fluids aged. The shape of the failure mode for pH decrease reveals a large initial drop over 1 to 2 days followed by a slight pH increase and stabilization of the system at a new lower level. This behavior is believed to be caused by rapid bacterial bloom over the first 1 to 2 days, followed by an equilibration of the biological system over the next 1 to 2 weeks. The blends containing no biocide were reduced in pH after only 1 to 2 days of testing, while blends containing biocide were significantly more stable. The blend containing 1.0% biocide degraded after 49 days, while mixtures containing biocide and antioxidant degraded anywhere from 21 to 33 days. The blends of biocide and phenolic anti-oxidant displayed a synergistic interaction.

The biological activity was evaluated using standard culture plates. The bacterial count was checked after 24, 30, and 48 hours of incubation. In Examples 25-34, the results varied depending on the incubation period selected, but under the bacterial counts used (due to inoculation) in this testing, there was no significant differences in the results based on incubation period.

When the onset of bacterial growth was measured after the initial biocide application, blends containing biocide (0.25%) and antioxidant (0.25%) were found to perform as well as the blend with biocide (0.5%) alone, but, surprisingly, the pH of the fluids remained unchanged at the onset of bacterial growth. If the aging of the fluids was continued until the pH dropped, it was found that cell culture count increased above $10^7$ bacteria/mL. While samples with no biocide "break" in both bacteria count and pH after only 1 to 2 days, the (0.5%) biocide reference fluid breaks after 7 weeks. Although the samples containing (0.25%) biocide and (0.25%) antioxidant might be expected to "break" after 3 to 4 weeks, a synergy was found where the mixed samples lasted 5 weeks (see Table 6).

TABLE 6

Bacterial Growth Results of ASTM D3946 Tests

| Additive MC93-87- | 52 | 53 | 54 | 55 | 56 | 57 | 58 | 59 | 60 | 61 |
|---|---|---|---|---|---|---|---|---|---|---|
| BHT | | | 0.5 | | | | 0.25 | | | |
| AX 15 | | | | 0.5 | | | | 0.25 | | |
| butylated DPA | | | | | 0.5 | | | | 0.25 | |
| NL640 | | | | | | 0.5 | | | | 0.25 |
| Triadine 3 | 0 | 0.5 | 0 | 0 | 0 | 0 | 0.25 | 0.25 | 0.25 | 0.25 |
| Shell MVI 100 | 80 | 79.5 | 79.5 | 79.5 | 79.5 | 79.5 | 79.5 | 79.5 | 79.5 | 79.5 |
| R-14D | 20 | 20 | 20 | 20 | 20 | 20 | 20 | 20 | 20 | 20 |
| Bacteria Count 10* | | | | | | | | | | |
| 0 day (24 hrs) | 7+ | 7+ | 7+ | 7+ | 7+ | 7+ | 7+ | 7+ | 7+ | 7+ |
| 1 day (24 hrs) | 7+ | 0 | 7+ | 7+ | 7+ | 7+ | 0 | 0 | 0 | 0 |
| 5 day (24 hrs) | 7+ | 0 | 7+ | 7+ | 7+ | 7+ | 0 | 0 | 0 | 0 |
| 7 day (24 hrs) | 7+ | 0 | 7+ | 7+ | 7+ | 7+ | 0 | 0 | 0 | 0 |
| 12 day (24 hrs) | 7+ | 0 | 7+ | 7+ | 7+ | 7+ | 0 | 0 | 0 | 0 |
| 3 weeks (24 hrs) | 7+ | 3 | 7 | 7 | 7+ | 5 | 0 | 0 | 4 | 0 |
| 4 weeks (24 hrs) | 7+ | 3 | 7+ | 7+ | 7+ | 7+ | 6 | 3 | 7 | 6 |
| 5 weeks (24 hrs) | 7+ | 3 | 7+ | 7+ | 7+ | 7+ | 7+ | 7+ | 7+ | 7+ |
| 6 weeks (24 hrs) | 7+ | 6 | — | — | — | — | — | — | — | — |
| 7 weeks (24 hrs) | 7+ | 7+ | — | — | — | — | — | — | — | — |

TABLE 6-continued

| | Bacterial Growth Results of ASTM D3946 Tests | | | | | | | | | |
|---|---|---|---|---|---|---|---|---|---|---|
| Additive MC93-87- | 52 | 53 | 54 | 55 | 56 | 57 | 58 | 59 | 60 | 61 |
| Onset | 0 | 3 | 0 | 0 | 0 | 0 | 4 | 4 | 4 | 4 |
| 0 day (30 hrs) | 7+ | 7+ | 7+ | 7+ | 7+ | 7+ | 7+ | 7+ | 7+ | 7+ |
| 1 day (30 hrs) | 7+ | 0 | 7+ | 7+ | 7+ | 7+ | 0 | 0 | 0 | 0 |
| 5 day (30 hrs) | 7+ | 0 | 7+ | 7+ | 7+ | 7+ | 0 | 0 | 0 | 0 |
| 7 day (30 hrs) | 7+ | 0 | 7+ | 7+ | 7+ | 7+ | 0 | 0 | 0 | 0 |
| 12 day (30 hrs) | 7+ | 0 | 7+ | 7+ | 7+ | 7+ | 0 | 0 | 0 | 0 |
| 3 weeks (30 hrs) | 7+ | 3 | 7+ | 7+ | 7+ | 6 | 0 | 0 | 5 | 0 |
| 4 weeks (30 hrs) | 7+ | 4 | 7+ | 7+ | 7+ | 7+ | 7 | 3 | 7+ | 7 |
| 5 weeks (30 hrs) | — | | — | — | — | — | — | — | — | — |
| 6 weeks (30 hrs) | — | | — | — | — | — | — | — | — | — |
| 7 weeks (30 hrs) | — | — | — | — | — | — | — | — | — | — |
| Onset | 0 | 3 | 0 | 0 | 0 | 0 | 4 | 4 | 3 | 4 |
| 0 day (48 hrs) | 7+ | 7+ | 7+ | 7+ | 7+ | 7+ | 7+ | 7+ | 7+ | 7+ |
| 1 day (48 hrs) | 7+ | 0 | 7+ | 7+ | 7+ | 7+ | 0 | 0 | 0 | 0 |
| 5 day (48 hrs) | 7+ | 0 | 7+ | 7+ | 7+ | 7+ | 0 | 0 | 0 | 0 |
| 7 day (48 hrs) | 7+ | 0 | 7+ | 7+ | 7+ | 7+ | 0 | 0 | 0 | 0 |
| 12 day (48 hrs) | 7+ | 0 | 7+ | 7+ | 7+ | 7+ | 0 | 0 | 0 | 0 |
| 3 weeks (48 hrs) | 7+ | 3 | 7+ | 7+ | 7+ | 6 | 0 | 0 | 5 | 0 |
| 4 weeks (48 hrs) | 7+ | 5 | 7+ | 7+ | 7+ | 7+ | 7+ | 4 | 7+ | 7+ |
| 5 weeks (48 hrs) | — | | — | — | — | — | — | — | — | — |
| 6 weeks (48 hrs) | 7+ | 7+ | — | — | — | — | — | — | — | — |
| 7 weeks (48 hrs) | 7+ | 7+ | — | — | — | — | — | — | — | — |
| Onset | 0 | 3 | 0 | 0 | 0 | 0 | 4 | 4 | 3 | 4 |

In summary:

1. The inoculation of the metalworking fluids decreases the total time required to run the oxidative and biological stability test.

2. The addition of antioxidant to metalworking fluids increases the stability based on pH measurements.

3. The addition of antioxidant to metalworking fluids increases the biological stability based on cell culture tests.

In view of the many changes and modifications that can be made without departing from principles underlying the invention, reference should be made to the appended claims for an understanding of the scope of the protection to be afforded the invention.

What is claimed is:

1. A composition, comprising:

at least one metalworking fluid comprising a water in oil metalworking emulsion wherein the oil phase consists essentially of naphthenic mineral oil, an emulsifier for the naphthenic mineral oil, 0.25 wt. % of an antioxidant selected from the group consisting of butylated (30%) and octylated (24%) diphenylamine and butylated (45%) and octylated (19%) diphenylamine, and 0.25 wt. % of a 1,3,5-tris(2-hydroxyethyl)-S-triazine;

wherein the diphenylamine and the 1,3,5-tris(2-hydroxyethyl)-S-triazine are present in amounts sufficient to reduce biological degradation by delaying bacteria onset by at least 18 weeks following a 1 day incubation period in accordance with ASTM 3946.

2. A composition, comprising:

at least one metalworking fluid comprising a water in oil metalworking emulsion wherein the oil phase consists essentially of naphthenic mineral oil, an emulsifier for the naphthenic mineral oil, 0.25 wt. % of a nonylated diphenylamine, and 0.25 wt. % of a 1,3,5-tris(2-hydroxyethyl)-S-triazine;

wherein the nonylated diphenylamine and the 1,3,5-tris(2-hydroxyethyl)-S-triazine are present in amounts sufficient to reduce oxidative degradation by having a total acid number of about 0.6 after 312 minutes of aging in accordance with ASTM D943 and sufficient to reduce biological degradation by delaying bacteria onset by at least 18 weeks following a 1 day incubation period in accordance with ASTM 3946.

* * * * *